US005996783A

United States Patent [19]

Herchelroth

[11] Patent Number: 5,996,783

[45] Date of Patent: Dec. 7, 1999

[54] CIGAR-CIGARETTE CARRYING CASE

[76] Inventor: Thurlow S. Herchelroth, 98 Locust Grove Rd., Bainbridge, Pa. 17502

[21] Appl. No.: 09/208,957

[22] Filed: Dec. 9, 1998

[51] Int. Cl.[6] ..... A24F 15/00

[52] U.S. Cl. ..... 206/261; 206/245; 206/268

[58] Field of Search ..... 206/268, 269, 206/261, 245, 242

[56] References Cited

U.S. PATENT DOCUMENTS

| | | | |
|---|---|---|---|
| 242,632 | 6/1881 | Gruner | 206/261 |
| 486,004 | 11/1892 | Ullin | 206/261 X |
| 522,881 | 7/1894 | Cronenwett, Jr. | 206/261 |
| 666,781 | 1/1901 | Urick | 206/261 X |
| 1,221,398 | 4/1917 | White | 206/261 |
| 2,071,394 | 2/1937 | Douglas . | |
| 4,465,184 | 8/1984 | Bruce | 206/261 |
| 4,901,739 | 2/1990 | Benavente et al. . | |
| 4,926,888 | 5/1990 | Lee . | |
| 5,224,499 | 7/1993 | Zayas . | |

FOREIGN PATENT DOCUMENTS

| | | | |
|---|---|---|---|
| 343353 | 10/1921 | Germany | 206/261 |

*Primary Examiner*—Bryon P. Gehman
*Attorney, Agent, or Firm*—Henderson & Sturm

[57] ABSTRACT

A carrying case 10 for tobacco products including a housing unit 11, a liner unit 12, and a latch unit 13. The housing unit 11 comprises a housing member 20 having two housing segments 21, 22 provided with central recesses 24 which define a central housing chamber 25 and wherein the liner unit 12 includes two thermally insulated liner segments 31, 32 dimensioned to accommodate at least one unsmoked tobacco product 100, as well as the ashes and butt of the tobacco product after it has been smoked.

9 Claims, 1 Drawing Sheet

CIGAR-CIGARETTE CARRYING CASE

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

The present invention relates to the field of smoker's accessories in general, and in particular to a butt and ash collecting receptacle for smokers to first transport whole smoking material and then transport both the consumed and unconsumed portions of the tobacco article.

2. Description of Related Art

As can be seen by reference to the following U.S. Pat. Nos. 2,071,394; 4,901,739; 4,926,888; and 5,224,499, the prior art is replete with myriad and diverse cigarette carrying cases, as well as cigar tubes and pouches.

While all of the aforementioned prior art constructions are more than adequate for the basic purpose and function for which they have been specifically designed, they are uniformly deficient with respect to their failure to provide a simple, efficient, and practical device that a smoker can use to transport an unlit tobacco article to a location where the tobacco article will be at least partially consumed and wherein the same device can be used to collect the ashes and the unconsumed portion of the tobacco article.

Given the fact that the act of smoking has been looked down upon for a number of years, and will be for the foreseeable future, smokers must constantly be vigilant and aware of any means possible to improve this public image.

As a consequence of the foregoing situation, there has existed a longstanding need for a new and improved type of carrying case for tobacco articles wherein the case serves to transport the unlit article, to collect the ashes from the article after the article is lit, and to extinguish without crushing the unconsumed portion of the cigarette or cigar, and the provision of such a device is a stated objective of the present invention.

BRIEF SUMMARY OF THE INVENTION

Briefly stated, the carrying case for tobacco articles that forms the basis of the present invention comprises in general, a housing unit, a liner unit, and a latch unit.

As will be explained in greater detail further on in the specification, the housing unit comprises a housing member having two housing segments hingedly connected together and provided with central recesses that define a central housing chamber dimensioned to transport an unsmoked tobacco product such as a cigar or cigarette to a location where the tobacco product can be smoked and then serve as a receptacle for the ashes and butt of the tobacco product.

While this invention also contemplates having the housing unit fabricated entirely of fiberglass which would obviate the need for a liner unit, the preferred embodiment of the invention has the housing member fabricated from metal, plastic, wood, leather, or the like while the liner unit is fabricated from a thermally insulated material, such as fiberglass, or the like.

In addition, the liner unit comprises a liner member including a pair of thermally insulated liner segments which are dimensioned to be received in and extend slightly beyond the periphery of the housing segment recesses to form an air tight seal for the central housing chamber.

Furthermore, in an alternate version of the preferred embodiment, the liner unit is partitioned to form two distinct compartments within the central housing chamber wherein one compartment holds fresh cigarettes or cigars and the other compartment holds ashes and butts.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
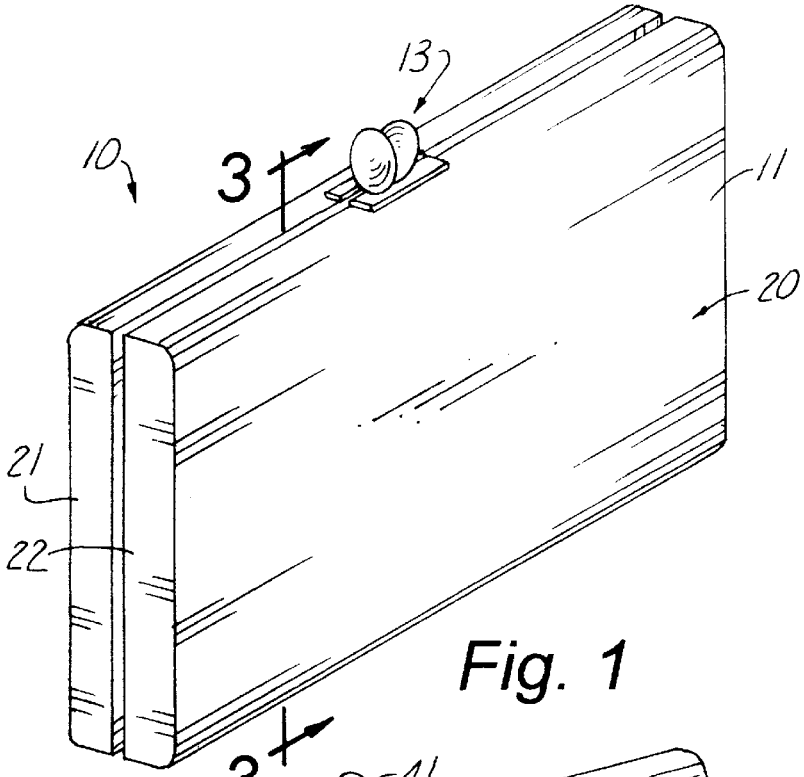
FIG. 1 is a perspective view of the cigar/cigarette carrying case that forms the basis of the present invention shown in the closed position.

As can be seen by reference to the drawings, and in particularly to FIG. 1, the cigar/cigarette carrying case the that forms the basis of the present invention is designated generally by the reference number 10. The carrying case 10 comprises in general, a housing unit 11, a liner unit 12, and a latching unit 13. These units will now be described in seriatim fashion.

Figure 3:
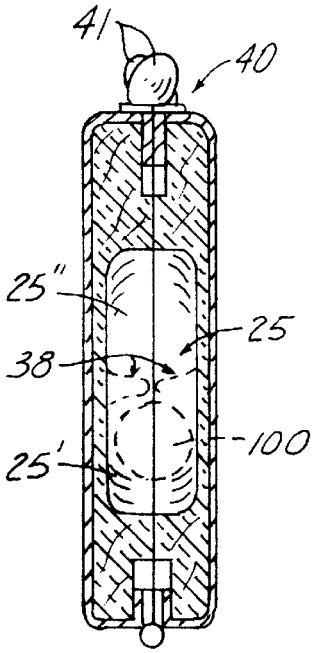
FIG. 3 is a cross sectional view taken through line 3-3 of FIG. 1.
Figure 2:
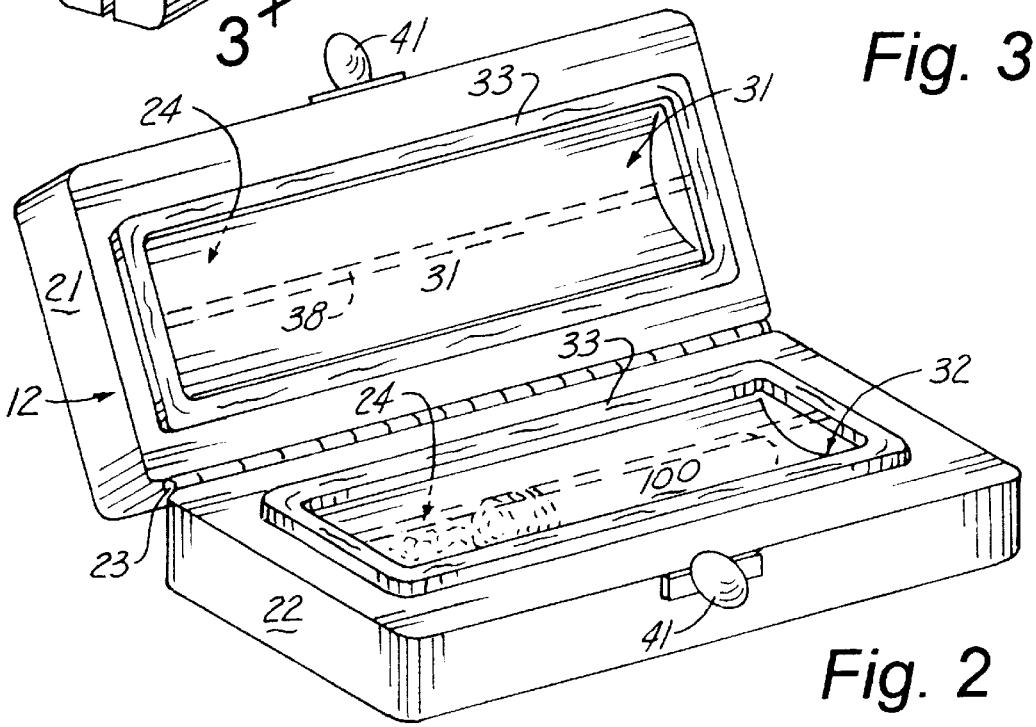
FIG. 2 is a perspective view of the carrying case shown in the open position.

As shown in FIGS. 1 through 3, the housing unit 11, comprises an elongated housing member 20 having two opposed housing segments 21, 22 hingedly connected as at 23 on their lower end and provided on their upper end with the latching unit 13 which will be described in greater detail further on in the specification.

As can best be appreciated by reference to FIGS. 2 and 3, the interior surface of each of the housing segments 21, 22 are provided with an elongated centrally disposed contoured recess 24 which cooperate with one another to define a central housing chamber 25 that is dimensioned to receive one or more cigars and/or cigarettes.

Still referring to FIGS. 2 and 3, it can be seen that the liner unit 12 comprises a liner member 30 that is dimensioned to conform to the interior of the central housing chamber 25 and includes two opposed thermally insulated liner segments 31, 32 that are preferably fabricated from fiberglass 33 or the like. The peripheral edges 34 of the liner segments 31, 32 project beyond the periphery of the central recess 24 in each of the housing segments 21, 22 and cooperate with one another to provide an airtight seal for the carrying case 10.

It should also be noted at this juncture that in the preferred embodiment of the invention, that the housing member is fabricated from metal 26 wherein the fiberglass liner member 33 prevents the heat from a glowing tobacco product 100 from being conducted to the surface of the metal. However, it is also envisioned that the housing member 20 may also be fabricated from plastic or the like. The fiberglass liner member 30 will prevent the heat from a glowing tobacco product 100 from melting the plastic material.

While the preferred embodiment of the invention depicted in the drawings contemplates a single central chamber 25 in the housing member 20 that will accommodate a single unburned cigar or cigarette, the central chamber 25 will serve as an ash receptacle as the tobacco product is being smoked and will then serve to transport the ashes and unconsumed butt portion of the tobacco product to a suitable disposal location. This invention also contemplates an alternate version that will be described next.

Still referring to FIGS. 2 and 3, it can be seen that in the alternate version of the preferred embodiment, the central housing chamber 25 is divided by a raised, elongated, transverse partition wall formed by a central divider element 38 formed in each of the liner segments 31, 32. The lower portion 25' of the central chamber 25 is designed and dimensioned to accommodate ashes and butts and to segregate the ashes and butts from one or more unsmoked tobacco products 100.

In addition, as can best be seen by reference to FIGS. 1 and 3, the latch unit 13 comprises an old fashioned purse style latch member 40 having a pair of cooperating latch arms 41 which releasably engage one another to form the closure mechanism for the carrying case. However, it is to be understood that any conventional latch mechanism could be substituted therefor in keeping with the teachings of this invention.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

Having thereby described the subject matter of the present invention, it should be apparent that many substitutions, modifications, and variations of the invention are possible in light of the above teachings. It is therefore to be understood that the invention as taught and described herein is only to be limited to the extent of the breadth and scope of the appended claims.

I claim:

1. A carrying case for smoked and unsmoked tobacco products wherein the carrying case comprises:

a housing unit including an elongated housing member having a pair of housing segments, each housing segment having an upper end and a lower end wherein the lower ends are hingedly connected together and wherein the interior surface of each of the housing segments are provided with an elongated contoured recess which define a central housing chamber;

a liner unit including a liner member having two elongated liner segments which are thermally insulated and dimensioned to conform to the contoured recess in each housing segment wherein both the housing segments and the liner segments are fabricated from fiberglass; and a latch member disposed on the upper end of each housing segment.

2. The carrying case as in claim 1 wherein the liner segments are fabricated from fiberglass.

3. The carrying case as in claim 2 wherein the liner segments have a peripheral edge which extends outwardly from the contoured recess in each housing segment.

4. The carrying case as in claim 2 wherein the housing segments are fabricated from metal.

5. The carrying case as in claim 2 wherein the housing segments are fabricated from plastic.

6. The carrying case as in claim 1 wherein the central housing chamber comprises a single chamber dimensioned to accommodate at least one unsmoked tobacco article.

7. The carrying case as in claim 1 wherein the central housing chamber comprises a partitioned chamber having an upper portion and a lower portion.

8. The carrying case as in claim 7 wherein one of said portions is dimensioned to accommodate at least one unsmoked tobacco product and the other portion is dimensioned to accommodate the ashes and butt of a smoked tobacco product.

9. The carrying case as in claim 1 wherein said housing segments and liner segments are formed integrally with one another.

* * * * *